US007164770B2

(12) United States Patent
Bottum

(10) Patent No.: US 7,164,770 B2
(45) Date of Patent: Jan. 16, 2007

(54) SURROUND SOUND SPEAKER SYSTEM

(76) Inventor: Bernard Bottum, 8169 S. Bedford Rd., Macedonia, OH (US) 44056

( * ) Notice: Subject to any disclaimer, the term of this patent is extended or adjusted under 35 U.S.C. 154(b) by 673 days.

(21) Appl. No.: 10/235,206

(22) Filed: Sep. 5, 2002

(65) Prior Publication Data

US 2003/0068051 A1 Apr. 10, 2003

Related U.S. Application Data

(60) Provisional application No. 60/317,217, filed on Sep. 5, 2001.

(51) Int. Cl.
*H04R 5/00* (2006.01)

(52) U.S. Cl. ..... 381/27; 381/99

(58) Field of Classification Search ..... 381/27, 381/306, 333, 99

See application file for complete search history.

(56) References Cited

U.S. PATENT DOCUMENTS 5,307,418 A * 4/1994 Sumitani ..... 381/27

6,782,111 B1 * 8/2004 Wagner et al. ..... 381/27

* cited by examiner

*Primary Examiner*—Ping Lee

(74) *Attorney, Agent, or Firm*—Gifford, Krass, Groh, Sprinkle, Anderson & Citkowski, P.C.

(57) ABSTRACT

The present invention uses multivoice coil drivers in conjunction with the small satellite speakers of multichannel surround sound systems to achieve an overall linear response between 100 Hz to above 15 KHz. The multivoice coil drivers are designed to respond only to frequencies that fall between conventional upper base and lower midrange crossover frequencies which typically extend between 75 Hz and 225 Hz. The invention relies on the characteristics of human hearing which limits the listener's ability to localize the source of sound approximately to the wavelength of the sound being heard. The system may be incorporated in existing front and rear center speakers or separate enclosures to supplement the overall surround sound system.

2 Claims, 5 Drawing Sheets

FIG. 4

| | SPEAKER DRIVER | FREQUENCY RESPONSE |
|---|---|---|
| | Subwoofer | Below 100Hz |
| Front Speakers | Lt. Front | 200–20 kHz |
| | Rt. Front | 200–20 kHz |
| Rear Speakers | Lt. Rear | 200–20 kHz |
| | Rt Rear | 200–20 kHz |
| | Ctr Rear | 200–20 kHz |
| Front Bridge (Center) | Single Coil (l+R) | 200–20 kHz |
| | Lt. Dual Coil | 100–200 Hz |
| | Rt. Dual Coil | 100–200 Hz |
| Rear Bridge | Triple Coil Driver | 100–200 Hz |
| | | |

SURROUND SOUND SPEAKER SYSTEM

REFERENCE TO RELATED APPLICATION

This application claims priority from U.S. provisional patent application Ser. No. 60/317,217, filed Sep. 5, 2001, the entire content of which is incorporated herein by reference.

FIELD OF THE INVENTION

The present invention relates to a speaker arrangement for a surround sound system, more particularly a speaker arrangement that provides a substantially linear frequency response throughout the audio bandwidth.

BACKGROUND OF THE INVENTION

Over the years, the world of home entertainment has changed dramatically. Today most U.S. households have a large color television with at least 50 viewing channels and a VCR or DVD. More and more people are adding additional audio components to their entertainment center to create home theater systems. The world of home theater is evolving and consumers have a wide range of options, particularly in the area of available speakers for producing the most theater-like sound within the home entertainment environment.

Speakers for use with home theater systems preferably reproduce all frequencies that the soundtrack delivers. Typically, this is considered to extend from about 20 hertz (cycles per second, also Hz) to 20 kilohertz (thousand cycles per second, also kHz). However, reproduction of this full range of frequencies is difficult, especially when the left, center, right and surround speakers are small in size. Speakers typically include one or more speaker drivers, each of which is capable of reproducing a certain range of frequencies. The basic types of speaker drivers are generally referred to as woofers, midrange drivers and tweeter (high frequency) drivers. It is important to note that to produce linear sound over a wide range of frequencies, you can break up the audio frequency range into several smaller sections that are each reproduced by one of these specialized drivers.

Woofers are physically the largest drivers and are designed to reproduce low frequency sounds, for example in subwoofers, those sounds occurring below 100 Hz. Next are the midrange drivers that are designed to reproduce a range of frequencies that extend typically between 200 Hz and as high as 5 kHz. To round out the array, the smallest of the drivers are the tweeter drivers. Because of their small size, the tweeters are better able to reproduce higher frequencies than midrange drivers.

From this, one may conclude that there is an optimum size for a driver depending upon the frequency range it is intended to reproduce. To produce high frequency sounds, which have shorter wavelengths, the speaker diaphragm must vibrate more quickly. Conversely, it is difficult for small drivers to move enough air to produce very low frequency sounds because of the small radiating area. To provide a speaker system that reproduces a wide range of frequencies, multiple drivers are typically used, often sharing a common enclosure.

It is well accepted that to achieve the best overall sound quality from a speaker system, it is important to ensure that such a system includes speakers designed to function together to produce a linear response throughout the entire audio bandwidth. However, in this light, an optimal speaker system may not be readily attainable or practical when considering factors such as size, cost and consumer appeal.

One traditional approach to providing full range sound while limiting the size of the front, left, right and rear surround speakers is to use a subwoofer. A subwoofer, which is a speaker having one or more woofer drivers, is typically used to reproduce low frequencies, typically only frequencies below 100 Hz. A subwoofer may be used without interfering with the imaging of the speaker system, because we hear low frequency sounds as non-directional. Satellite speakers are then used in various positions, such as front left and right, and for the rear surround speakers. These satellites may be smaller since they are not required to produce low frequency sound. Instead, they produce higher frequency sounds, which we perceive as being directional. These satellite speakers typically include only a small woofer, and midrange and/or tweeter drivers. The use of smaller drivers allows the satellites to be smaller than a "full range" speaker. The smaller the satellite, typically the higher the bass cutoff frequency.

The problem that remains herein is that small satellite speakers using 3½ inch or smaller woofers cannot reproduce low distortion sound pressure levels of above 100 db at frequencies as low as 100 Hz, the recommended highest crossover frequency to subwoofers for most surround sound systems. An added problem is that most surround sound receivers do not permit the option of extending the upper frequency cutoff of the subwoofer to above 100 Hz. The present invention seeks to provide a new technological approach that would in effect create a "bridge" between the subwoofer and the small satellite speakers to improve the overall audio quality of the surround sound speaker system.

SUMMARY OF THE INVENTION

The present invention provides a space-saving and cost-effective advantage over existing surround sound speaker systems by using multivoice coil drivers within the system to enhance the overall linear response of the system, in particular from between 100 Hz to approximately 250 Hz, the range of diminished output systems using small satellites.

The system provides an audio device intended for use with a surround sound system having an audio receiver with a plurality of channel outputs, including a left front, a right front, a center front, a left rear, a right rear, possibly one or two additional rear channels, and a subwoofer.

The audio device includes inputs for interfacing with the channel outputs of the audio receiver and preferably operates to produce a sound pressure level (SPL) above 100 db for audio frequencies between an upper crossover frequency of 100 Hz for a bass speaker (subwoofer) and 250 Hz, or more particularly the frequencies above 100 Hz which are diminished due to the small size of the satellite.

One means to implement the audio device is within the front center channel speaker with woofer drivers large enough to extend down to 100 Hz. Conventional front center channel speakers use two woofers. To extend down to 100 Hz at 100 db, these woofers must typically be 4¼ inches or larger in size.

With two dual voice coil woofers, two of the four voice coils can uniquely be used to fill in the diminished response of the front, left and rear satellites.

The first dual voice coil driver is optimally connected to the audio receiver such that it receives one input from the receiver's left front channel output and one input from the receiver's center channel output. The voice coil which creates the fill for the left front satellite is operative over only the diminished frequencies above 100 Hz. This would typically be approximately 250 Hz with satellites using a 2½ inch woofer and 175 Hz with satellites using a 3½ inch woofer.

In a similar manner, the second dual voice coil driver receives one input from the right channel output of the audio receiver and one input from the center channel output. Here again, the second dual voice coil only produces those portions of the audio signal that are required to fill in the diminished frequencies from above 100 Hz.

To facilitate connection to the surround sound system components, the audio device which operates as a "sub/sat bridge" includes multiple inputs/outputs (I/O)s. Preferably, three input and two output connectors are accessible at the rear face of the enclosure. The three input connectors include a left, a center and a right channel input. There is one output connector for the left satellite and one output connector for the right satellite.

Electrical connections are made internal to the audio device between the left input connector and the left output connector in addition to being connected to one coil of the first dual voice coil driver. Similarly, the right channel input port is connected to the right channel output connector as well as to one coil of the second dual voice coil driver.

The center channel input is connected to the other coil of both the first and second dual voice coil drivers as well as being connected to the single voice coil midrange and/or tweeter.

The left and right output connectors of the audio device allow for connecting to the left and right front satellite speakers, respectively. The audio signal received from the left and right channel outputs of the receiver are simply passed through the respective output connectors of the device to the left and right satellite front speakers unimpeded. Thus, the left and right satellite speakers are able to reproduce all frequencies within their normal operating range, typically those frequencies that fall between 200 Hz and 20 kHz. The audio device fills in the diminished frequencies from above 100 Hz up to a maximum of about 250 Hz.

BRIEF DESCRIPTION OF THE DRAWINGS

A better understanding of the present invention will be had upon reference to the following detailed description when read in conjunction with the accompanying drawings in which like parts are given like reference numerals and wherein:

FIG. 4 is a chart illustrating the frequency response of the surround sound speaker system as according to the invention.

DETAILED DESCRIPTION OF THE INVENTION

Figure 1:
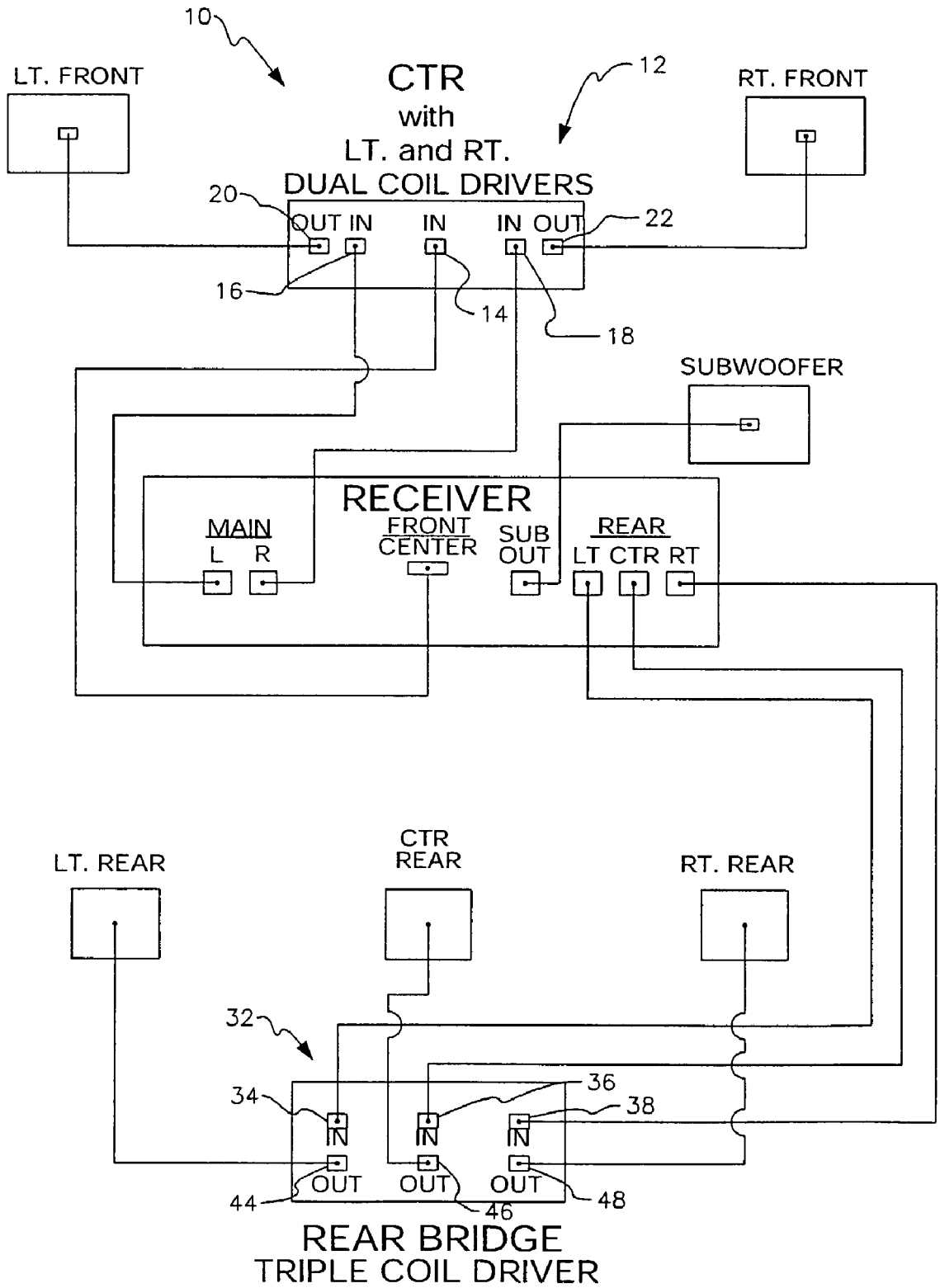
FIG. 1 is a wiring diagram that includes the present invention.

With reference to FIG. 1, the wiring diagram for a surround sound system includes the embodiments of the present invention 12 and 32, which provide a means of creating an acoustic bridge between the subwoofer and satellite speakers of the system.

The invention is intended for use with a conventional surround sound system that includes a multichannel output receiver, which preferably includes at least five output channels. These include a left, a right, and a center front channel; at least a left and right rear channel; and a subwoofer channel. The system illustratively has the following satellite speakers in addition to the subwoofer/low frequency effects (LFE) speaker: a left front, a right front, a center front, a left rear, and a right rear.

FIG. 4 illustrates the typical frequency response range of the above-identified speakers in addition to the preferred responses of the multivoice coil drivers to be used with the present invention. As illustrated, the front and rear satellite speakers typically reproduce frequencies between 200 Hz and 20 kHz. Although not illustrated, a typical center front speaker will reproduce frequencies between 100 Hz and 20 kHz and is conventionally constructed to include a tweeter, and a left front and a right front midrange/woofer, all mounted within one enclosure.

A preferred embodiment of the present invention provides a substitute for the conventional front center speaker to effectively create an acoustic bridge between the upper frequency response of the subwoofer and the lower midrange response of the satellite speakers. Illustratively, this range of frequencies extends between approximately 100 and 200 Hz.

Referring again to FIG. 4, a preferred embodiment of the present invention substitutes the left and right single voice coil drivers conventionally mounted within the front center speaker with left and right dual voice coil drivers of which two voice coils only respond to frequencies between approximately 100 and 200 Hz and operate in conjunction with the left and right front satellites.

The present invention uses left and right dual voice coil drivers in the center speaker as substitutes for the left and right single voice coil drivers traditionally used therein. Limiting the frequency response of these dual voice coil drivers to between 100 and 200 Hz effectively allows for the upper bass/lower midrange frequency sound source to be detached and repositioned up to approximately six feet from the satellite speakers which adequately reproduce frequencies above 200 Hz. In other words, because listeners cannot easily identify the location of frequencies in the 100 to 200 Hz range, these frequencies can be reproduced by the center channel speaker instead of, or as a supplement to, the left and right satellite speakers. A 200 Hz wavelength is approximately 5½ feet long. As such, the left and right front satellites may each be positioned up to approximately 5½ feet from the center speaker without the listener perceiving that the upper bass/lower midrange sound is coming from the center speaker, rather than from the front satellites and/or the subwoofer. Because the front center speaker is close to ear level and midway between the left and right front satellites, it is the optimum means to fill the missing frequencies between small left and right satellites and the subwoofer.

Figure 2A:
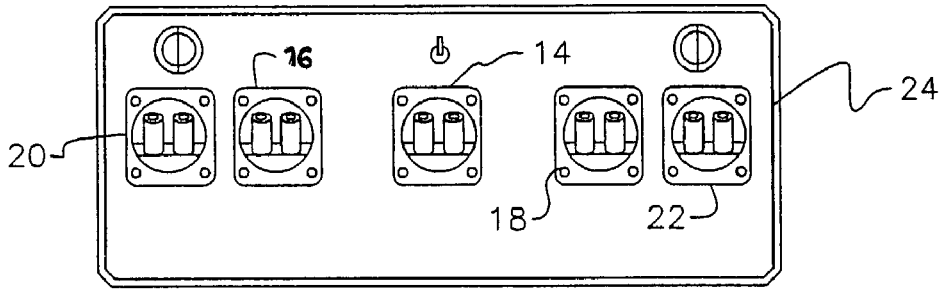
FIGS. 2A and 2B illustrate front and rear plan views of a preferred embodiment of the present invention, respectively.
Figure 2B:
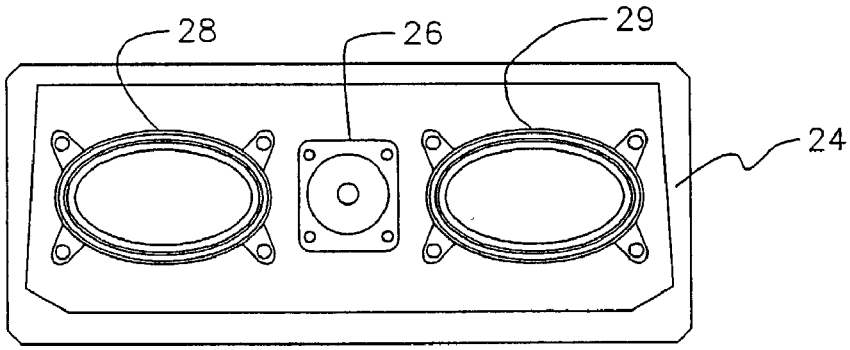

As best illustrated in FIGS. 2A and 2B, a preferred embodiment of the audio device according to the present invention comprises an enclosure 24 having a single voice coil driver 26 mounted between first and second dual voice coil drivers, 28 and 29.

Figure 5:
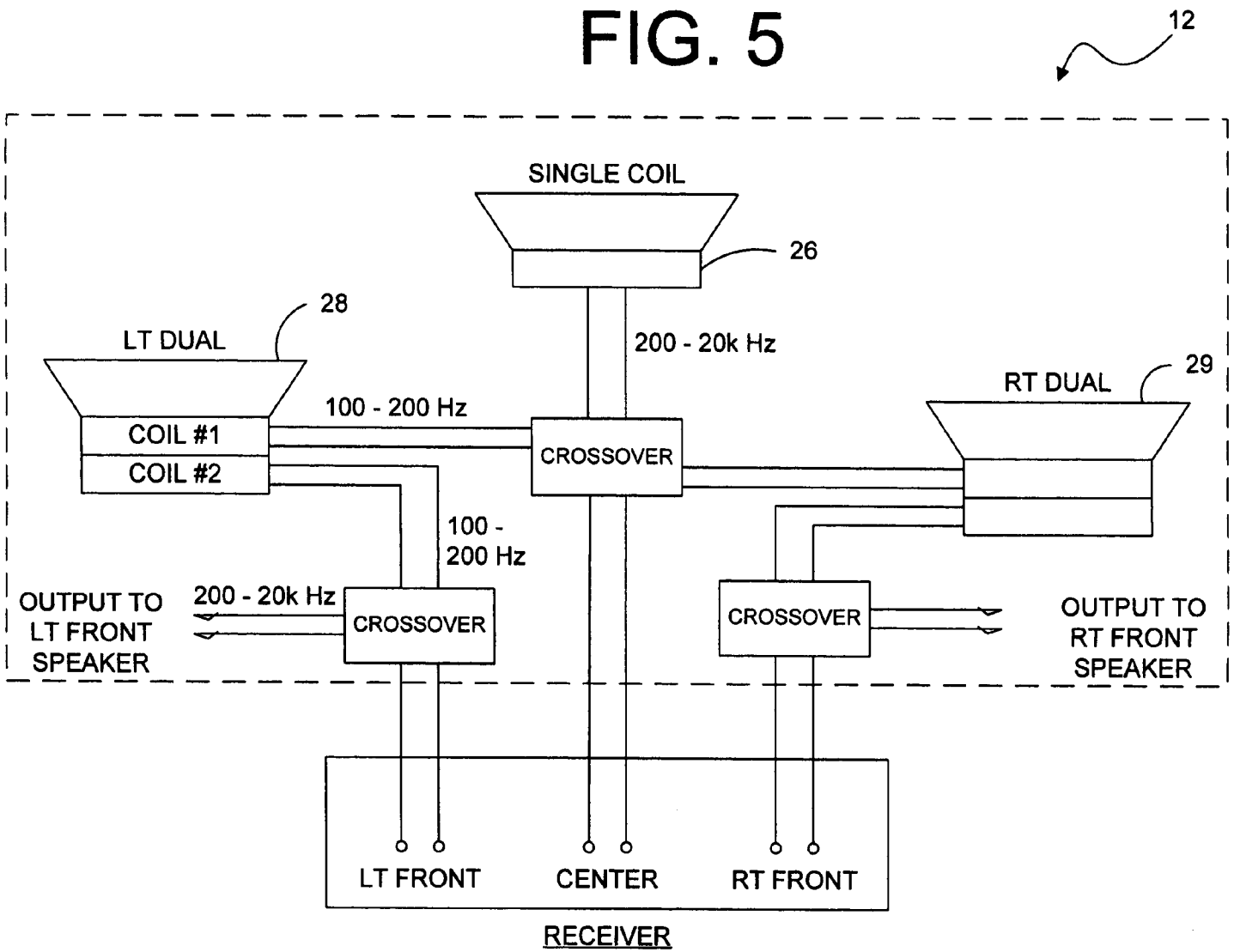
FIG. 5 is a wiring diagram illustrating the internal connections of the audio device as according to the invention.

Reference FIGS. 1 and 5 illustrate how the center input 14 connects to the single voice coil driver 26 and also connects to one coil of both the left and right dual voice coil drivers, 28 and 29. The other coil of the left dual voice coil driver 28 is connected to left input 16, which receives an input from the left channel output of the system receiver. The left input 16 also connects to a left output 20 (FIG. 1) that allows for the audio signal from the left channel output of the receiver to be passed through the audio device 12 to the left front satellite speaker. Similarly, the other coil of the right dual voice coil driver 29 is connected to the right input 18 that receives a signal from the right output channel of the system receiver. The right input 18 is electrically connected with a right output 22 that allows for the audio signal from the right channel output of the receiver to be passed through to the right front satellite speaker. For purposes of the present invention, a dual voice coil driver is a speaker driver with two voice coils. Such a driver can be driven by two signals at the same time, causing the driver to behave like two drivers combined into one.

The single voice coil midrange/tweeter in the center speaker system preferably will respond to all frequencies above their crossover frequency from the dual voice coil drivers up to at least 15 kHz. The other half of the left and right dual voice coil drivers will preferably only respond to frequencies between 100 and approximately 200 Hz that are received from the left and right output channels of the receiver, respectively. It should be noted that the single voice coil driver 26 may actually be more than one driver. For example, a midrange driver and a tweeter may both be provided to more accurately reproduce the range of frequencies.

The frequency response of the preferred embodiment of the invention creates the effect of "filling in" or "bridging" the gap between the upper end of the bass produced by the subwoofer and the lower midrange frequencies produced by the satellites to achieve an overall linear response from slightly below 100 Hz to above 15 kHz.

Figure 2C:
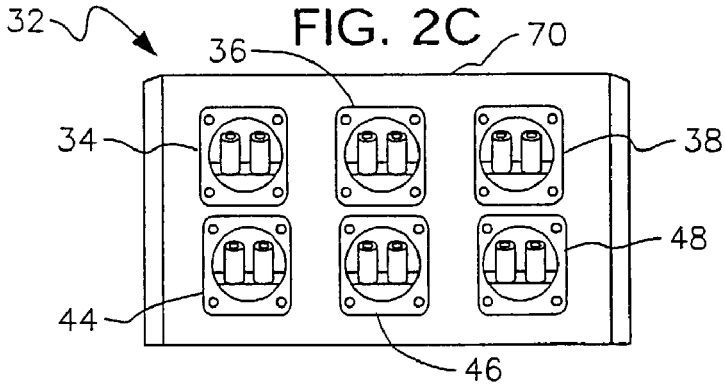
FIGS. 2C and 2D illustrate rear and top plan views of an alternative embodiment of the present invention, respectively.
Figure 2D:
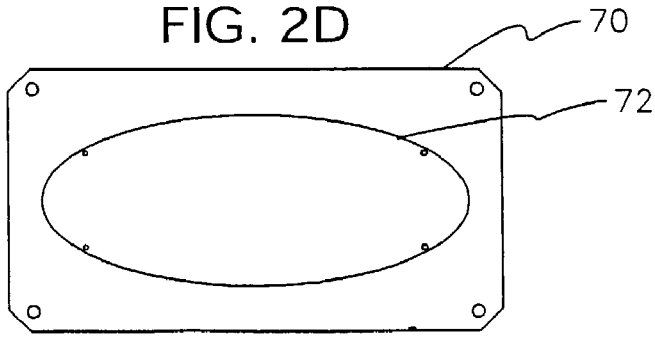

An alternative embodiment of the invention is illustrated in FIGS. 2C and 2D, wherein the audio device 32 comprises an enclosure 70 and one triple or quadruple voice coil driver 72 mounted therein. Here again, the multicoil driver preferably is operative to respond only to audio frequencies between the upper bass of the subwoofer and the lower midrange crossover frequencies of the satellites. FIGS. 2C and 2D illustrate an alternative embodiment of the invention using a triple voice coil driver. The audio device 32 (FIGS. 1 and 5) includes three input connectors 34–38 and three output connectors 44–48. The three input connectors receive input from the left, center and right output channels from the receiver while the three output connectors simply allow for the audio signal received from the left, center and right output channels of the receiver to be passed on to the respective satellite speakers.

This alternative embodiment allows for the audio device 32 to be housed in a separate enclosure where it can be placed behind, below or next to the television set to achieve a similar result as with the preferred embodiment of the invention. It is appreciated that this alternative embodiment may also be used with the system's rear speakers to achieve a similar result. Further, this alternative embodiment may be constructed using triple or quadruple voice coil drivers to create a fill for three or four rear satellites, respectively.

Figure 3:
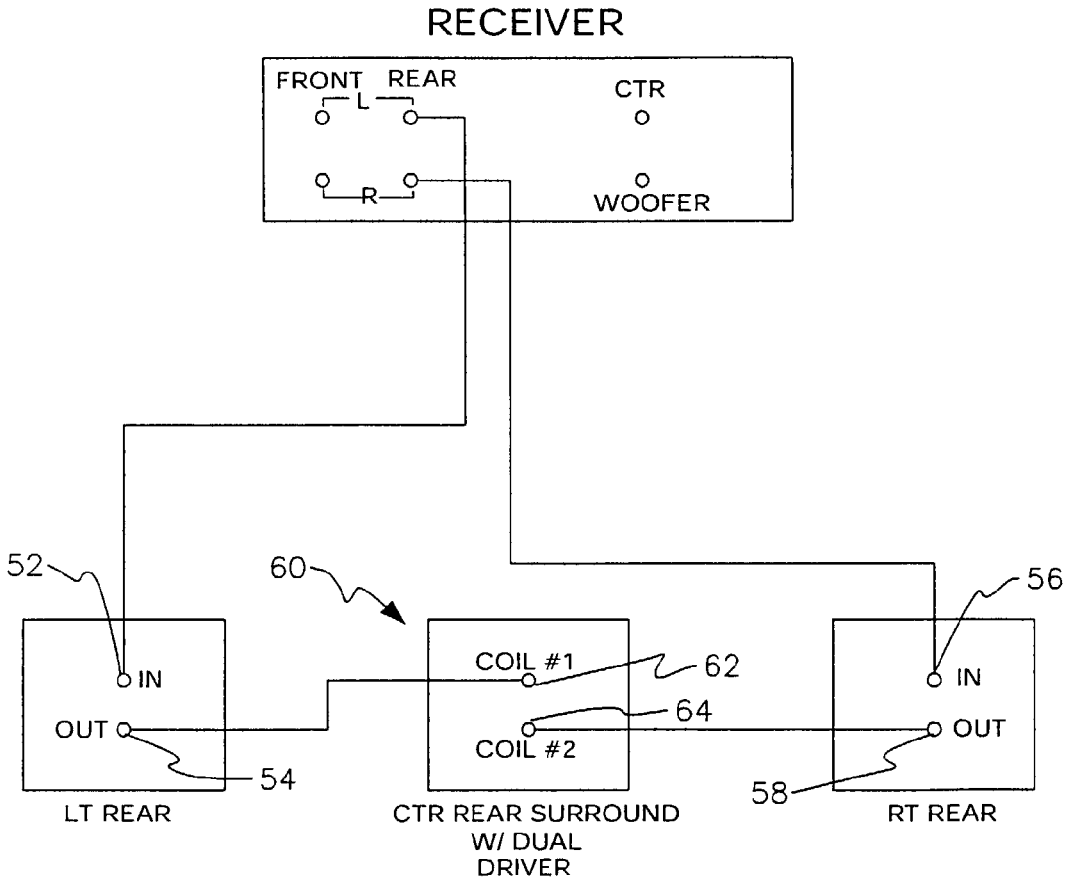
FIG. 3 is a wiring diagram that illustrates how the present invention may be used to combine the left rear and right rear channels to form a rear center channel.

Referring now to FIG. 3, another alternative embodiment provides an audio device 60 that is operative to combine two rear channel outputs from the receiver. Illustratively, the device will include a dual voice coil driver that receives inputs from the left and right rear channel outputs of the receiver, whereby the sum of the left and right rear channels is essentially created and output as a single audio signal. This provides an alternative option to accomplishing a similar result by combining the left and right signals in the amplifier for feeding a rear center channel speaker. As a result, the consumer would not have to pay an extra premium for a receiver with a built in feature which is sometimes referred to as "virtual matrix 6.1 surround." An additional application to create a fill for the diminished frequencies between 100 Hz and approximately 200 Hz in a small center speaker would be to use dual voice coil woofers in a bookshelf or tower speaker placed on the left and right side of the center speaker. The signal would pass from the receiver's center channel output to the center channel speaker input, and connect via terminals in the center channel speaker, out to one of the coils of the woofer(s) in the left and/or right bookshelf or tower speaker, which would have an upper frequency cutoff of approximately 200 Hz, or that frequency where the diminished output in the center speaker begins.

The foregoing figures and descriptions herein are provided as illustrative of some of the preferred embodiments of the concepts of this invention and are not intended to be all inclusive. It is understood that various changes to these essential components and conditions of the apparatus may be resorted to without departing from the spirit of the invention or the scope of the claims as presented.

I claim:

1. An audio device for use with a surround sound system incorporating a receiver that includes a plurality of channel outputs wherein said plurality of channel outputs include a minimum of a left front speaker, a right front speaker, a center front speaker, and a subwoofer, said audio device operative to reproduce frequencies between an upper bass frequency of the subwoofer and a lower midrange frequencies for the left and right front speakers, said audio device comprising:

an enclosure;

a first dual voice coil driver mounted within said enclosure and having a first coil operatively connected to respond only to frequencies between the upper bass frequency of the subwoofer and the lower midrange frequency of the left front speaker and a second coil operatively connected to respond only to frequencies between the upper bass frequency of the subwoofer and the lower midrange frequency of the center front speaker;

a second dual voice coil driver mounted within said enclosure and having a first coil operatively connected to respond only to frequencies between the upper bass frequency of the subwoofer and the lower midrange frequency of the right front speaker and a second coil operative to respond only to frequencies between the upper bass frequency of the subwoofer and the lower midrange frequency of the center front speaker; and a single voice coil midrange/tweeter driver mounted within said enclosure and connected through a crossover circuit to respond to frequencies above the lower midrange frequency of said center speaker.

2. The device of claim 1 wherein said upper bass frequency is about 100 Hz and said upper midrange frequency is approximately 200 Hz.

* * * * *